US007431247B2

(12) United States Patent
Bobro

(10) Patent No.: US 7,431,247 B2
(45) Date of Patent: Oct. 7, 2008

(54) BIPOD FOR A RIFLE OF OPTICAL INSTRUMENT

(76) Inventor: Andrew Bobro, 545 Lorraine Ave., Santa Barbara, CA (US) 93110

( * ) Notice: Subject to any disclaimer, the term of this patent is extended or adjusted under 35 U.S.C. 154(b) by 6 days.

(21) Appl. No.: 10/968,319

(22) Filed: Oct. 18, 2004

(65) Prior Publication Data

US 2008/0006747 A1 Jan. 10, 2008

Related U.S. Application Data

(60) Provisional application No. 60/515,182, filed on Oct. 27, 2003.

(51) Int. Cl.
*F16M 11/02* (2006.01)

(52) U.S. Cl. ..... 248/178.1; 248/177.1; 248/176.1; 42/94; 42/72; 42/124; 89/37.04; 89/37.01; 89/37.03; 89/37.05

(58) Field of Classification Search ..... 248/178.1, 248/177.1, 176.1, 157, 167, 165, 166; 42/94, 42/72, 124; 89/37.04, 37.01, 37.03, 37.05
See application file for complete search history.

(56) References Cited

U.S. PATENT DOCUMENTS 4,580,362 A * 4/1986 Stevens ..... 42/1.01
4,625,620 A * 12/1986 Harris ..... 89/37.04
4,903,425 A * 2/1990 Harris ..... 42/94
5,711,103 A * 1/1998 Keng ..... 42/94
5,815,974 A * 10/1998 Keng ..... 42/94
6,196,504 B1 * 3/2001 Lemke ..... 248/187.1
6,517,133 B2 * 2/2003 Seegmiller et al. ..... 294/139
7,143,986 B1 * 12/2006 Austin et al. ..... 248/187.1
2005/0188597 A1 * 9/2005 Keng et al. ..... 42/94
2005/0242250 A1 * 11/2005 Keng et al. ..... 248/168
2006/0278797 A1 * 12/2006 Keng et al. ..... 248/440.1

OTHER PUBLICATIONS

Applicants Admitted Prior Art (AAPA) as identified by Figure 1 of the "replacement" drawing, which the applicant submitted on Jun. 19, 2006.*

* cited by examiner

*Primary Examiner*—Carl D. Friedman
*Assistant Examiner*—Todd M. Epps

(57) ABSTRACT

A bipod operable for attachment to a bipod mounting plate having at least one transverse slot on a lower surface thereof, the upper surface of the bipod mounting plate including attachment means operable for attaching the mounting plate to a firearm or optical device. The bipod includes a bipod mounting bracket operable for rigidly and adjustably attaching the bipod to the bipod mounting plate. The bipod further includes a pair of telescopically extendable legs pivotally attached to the mounting bracket. The pivotal attachment means is operable for manually adjusting the angle of orientation of the legs with respect to the mounting bracket between zero degrees and a preset angle of less than 180 degrees and most preferably about 90 degrees. The pivotal attachment means further includes beveled detents that enable the silent locking of the legs into the desired angular orientation.

1 Claim, 5 Drawing Sheets

BIPOD FOR A RIFLE OF OPTICAL INSTRUMENT

This application claims the benefit of U.S. Provisional Application No. 60/515,182, filed Oct. 27, 2003.

BACKGROUND OF THE INVENTION

1. Field of the Invention

The present invention relates to a bipod operable for providing a platform for supporting and stabilizing a firearm or optical instrument.

2. Prior Art

Bipods are known for use with optical devices such as lasers and modern firearms to reduce tremor and improve their accuracy. Generally speaking, the advantages of a bipod are best realized when the user is prone or in a sitting position or at a low rest position such as shooting from a bench. Regardless of the shooting or sighting position chosen, the use of a bipod can improve accuracy, reduce fatigue and enhance the comfort of the user. In order to be most useful and versatile, bipod leg length should be easily adjustable and the bipod should be movable between a position supporting the firearm (or optical instrument such as a laser) and a position which does not interfere with use of the laser or firearm when the bipod is not in use.

Bipods are known in the art. Harris, in U.S. Pat. No. 4,625,620, discloses a bipod for a rifle that is more or less exemplary of the state of the art. The bipod has a base which is attachable to the sling swivel stud on the forearm of the rifle, a pair of adjustable telescoping legs pivotally attached to the base which legs can be pivoted between a support position and a folded position generally parallel to the rifle barrel, and a pair of strut mechanisms, each strut being operable for selectably bracing a leg with respect to the base, each strut mechanism further providing resilient means for absorbing recoil of the rifle.

Prior art bipods have limitations that may impair their use in, for example, silent, nonreflective operation for clandestine military or police operations. There is a need for a bipod having two collapsible legs pivotally affixed to a mounting plate wherein the mounting plate is attached to an optical device or firearm and is adapted for securely attaching the optical device or firearm to the bipod. In particular, there is a need for a nonreflective bipod wherein the legs can be folded, unfolded and extended silently. There is a further need for a bipod having foldable, telescopically extendable legs comprising means for clearing debris from the legs after use.

SUMMARY

It is an object of the present invention to provide a bipod having means for secure attachment of the bipod to a firearm or optical device that has a mounting plate attached thereto, thereafter the bipod being operable for positionally stabilizing the firearm or optical device with respect to a grounded surface.

It is a further object of the invention to provide a bipod meeting the above objective and wherein the bipod comprises two telescopically extendable legs, each leg having a fixed end pivotally attached to a mounting bracket by pivotal attachment means and a free end in opposition to the fixed end.

It is still a further object of the invention to provide a bipod meeting the above objectives wherein the pivotal attachment means further includes detent means operable for locking the legs in a folded or an unfolded position with respect to the mounting bracket and wherein the legs can be silently moved between the folded and unfolded position.

The features of the invention believed to be novel are set forth with particularity in the appended claims. However the invention itself, both as to organization and method of operation, together with further objects and advantages thereof may be best understood by reference to the following description taken in conjunction with the accompanying drawings.

DESCRIPTION OF THE PREFERRED EMBODIMENTS

Figure 1:
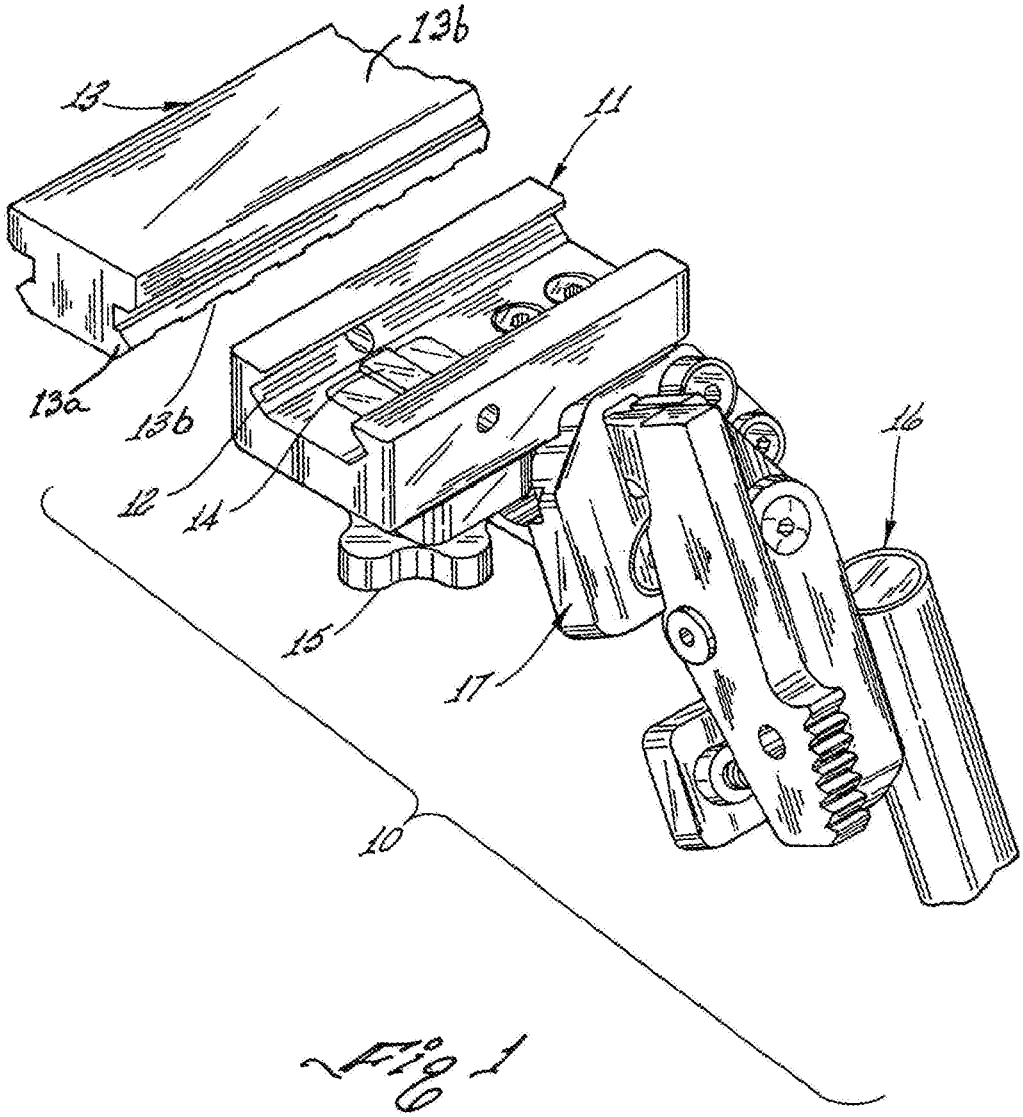
FIG. 1 is a perspective view of a bipod in accordance with the present invention showing the bipod mounting bracket, one of the two legs and the pivotal attachment means connecting the leg to the mounting bracket.
Figure 2:
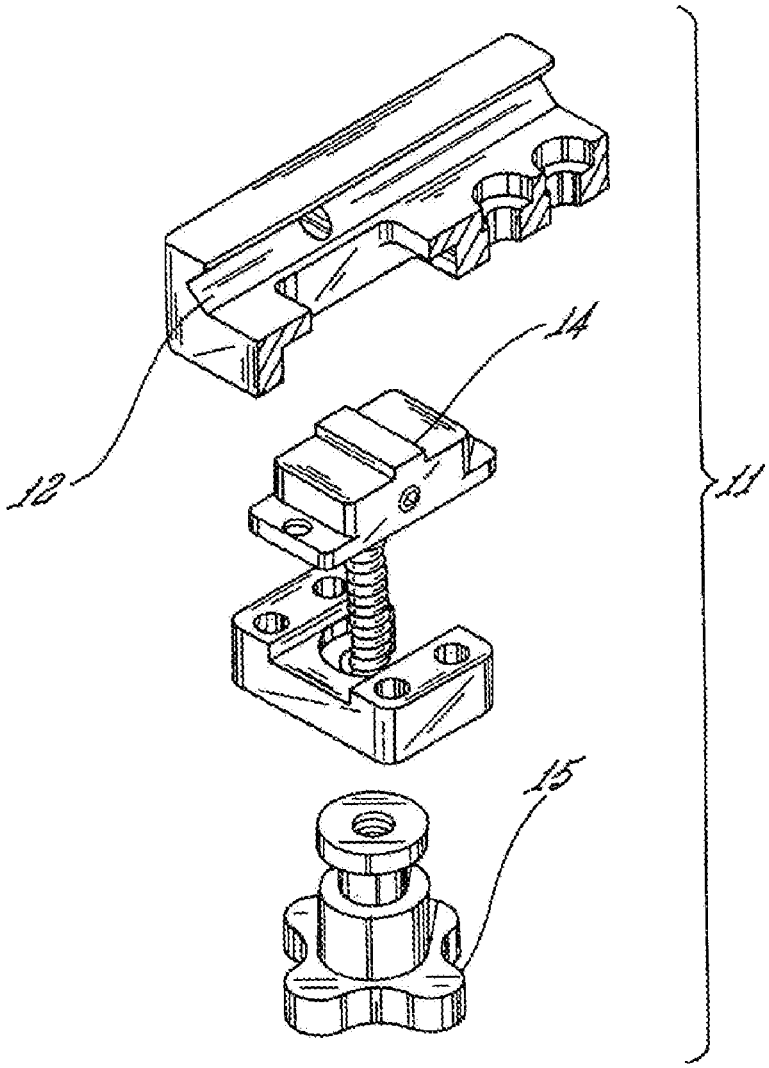
FIG. 2 is an exploded perspective view of the bipod mounting bracket.
Figure 3A:
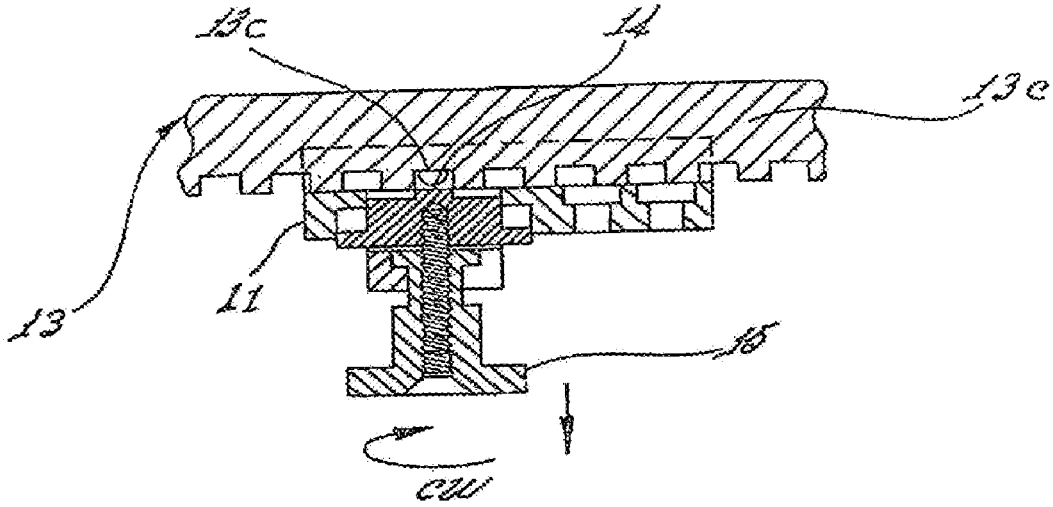
FIG. 3*a* is a longitudinal cross-sectional view of the bipod mounting bracket illustrating the attachment of the mounting bracket to the bipod mounting plate prior to engagement of the mounting bracket to the mounting plate.
Figure 3B:
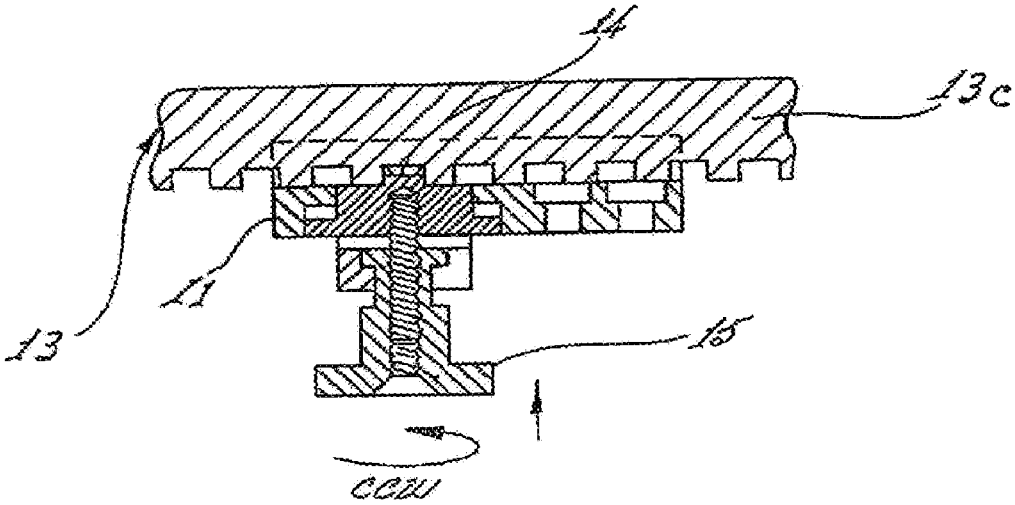
FIG. 3*b* is a longitudinal cross-sectional view of the bipod mounting bracket illustrating the attachment of the mounting bracket to the bipod mounting plate after engagement of the mounting bracket to the mounting plate.
Figure 4:
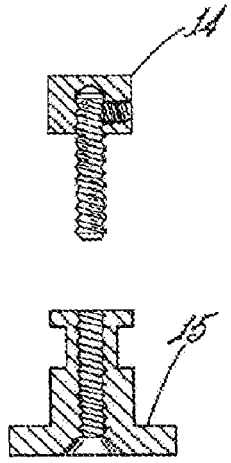
FIG. 4 is an exploded longitudinal cross-sectional view of the locking mechanism in the mounting bracket that enables the secure attachment of the bipod mounting bracket to the bipod mounting plate.

A bipod in accordance with the present invention, indicated at numeral 10, is illustrated in perspective view in FIG. 1. The bipod 10 has a bipod mounting bracket 11 with a beveled groove 12 operable for receiving a matingly beveled edge 13*a* of a (prior art) bipod mounting plate 13 therewithin. The upper surface 13*a* of the prior art bipod mounting plate 13 is preferably affixed to a firearm or an optical device (not shown) by attachment means (also not shown) such as a threaded hole. The opposing lower surface 13*b* of the bipod mounting plate 13 has a plurality of transverse slots 13*c* therein. To attach the bipod 10 to the bipod mounting plate 13, the mounting plate 13 is slid into the beveled groove 12 until an appropriate transverse slot 13*c* on the lower surface 13*b* of the bipod mounting plate 13 overlies an adjustable rectangular projection 14 on the bipod mounting bracket 11. A knurled knob 15 is turned in a clockwise direction as shown in FIG. 3*b* to advance the rectangular projection 14 into one of the transverse slots 13*c* thereafter to fit snugly therewithin. Counterclockwise rotation of the knob 15 retracts the rectangular projection 14 from within the transverse slot 13*c* to enable adjustment and/or disengagement of the bipod 10 from the bipod mounting plate 13.

With continued reference to FIG. 1, the bipod 10 further comprises a pair of pivotally mounted legs 16 (only the upper end of one leg is shown for clarity) affixed to the bipod mounting bracket 11 by pivotal locking means 17. The construction and operation of the pivotal locking means 17 is a key feature of the invention and is illustrated in detail in FIGS. 5-8.

Figure 5:
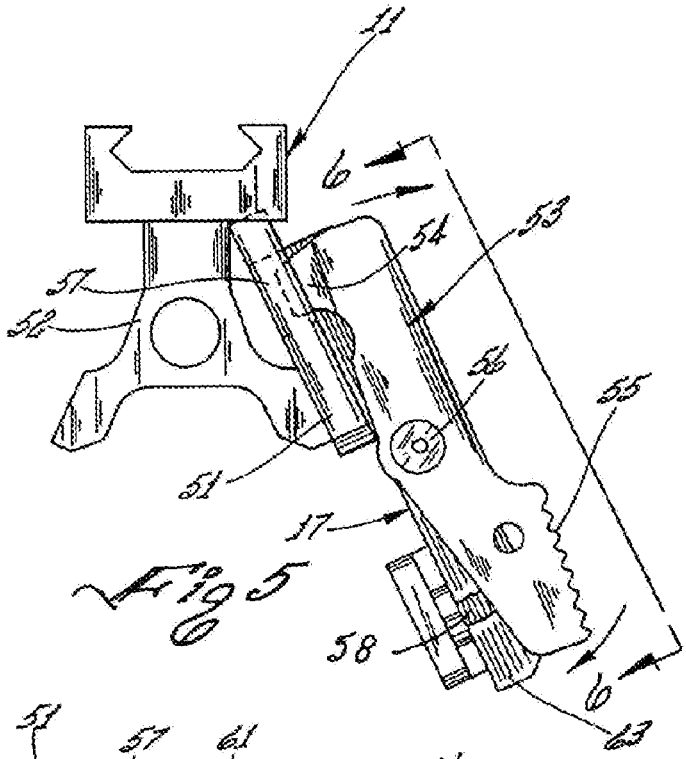
FIG. 5 is a front elevational view of the pivotal attachment means showing the beveled locking means on the lock/release lever seated within a beveled detent slot when the leg of the bipod is fully unfolded.
Figure 6:
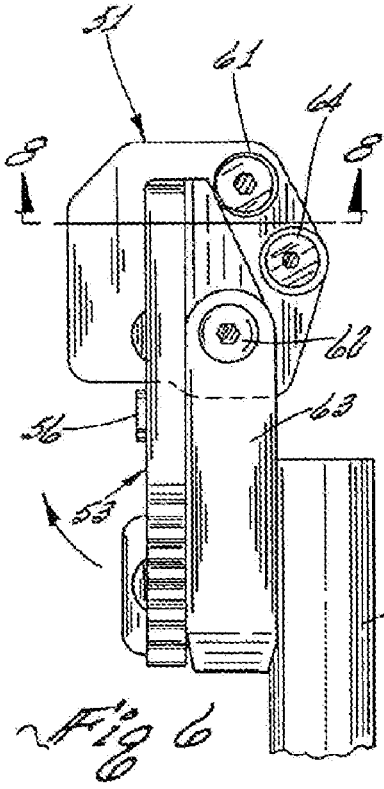
FIG. 6 is a side view taken in the direction indicated by view line 6-6 in FIG. 5 of the pivotal attachment means showing the beveled locking means on the lock/release lever seated within a beveled detent slot when the leg of the bipod is fully unfolded. The plate mounting bracket is removed for clarity.
Figure 7:
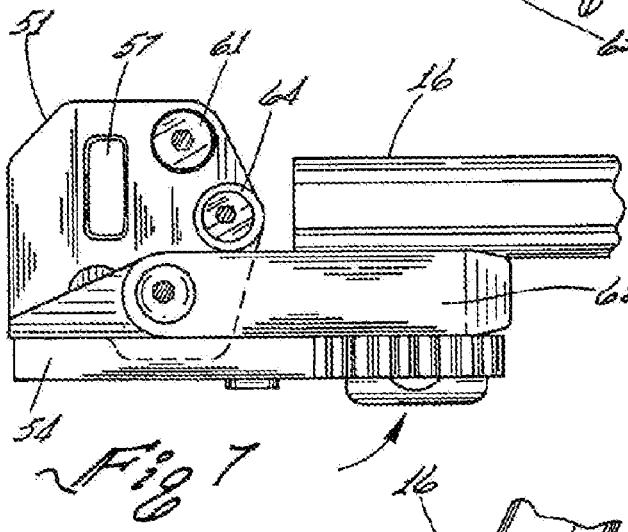
FIG. 7 is a side view of the pivotal attachment means showing the beveled locking means on the lock/release lever abutting a face of the pivotal attachment means thereby locking the leg in a folded position. The plate mounting bracket is removed for clarity.
Figure 8:
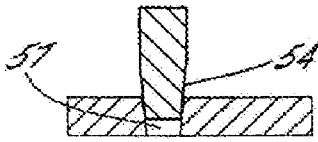
FIG. 8 is a detailed cross-sectional view taken along section line 8-8 of FIG. 6 illustrating the beveled locking means seated within the beveled detent slot on the pivotal attachment means when the legs of the bipod are unfolded and in a locked position.

Turning now to FIG. 5, the pivotal locking means 17 is illustrated in front view. A slotted plate 51 is rigidly attached to a bipod mounting bracket support 52. The pivotal locking means 17 further includes a lever 53 having a beveled detent 54 on one end thereof, a manually-depressable actuator portion 55 on the opposing end of the lever 53 and a pivot rivet 56 therebetween. A spring 58 urges the actuator portion upwardly thereby forcing the beveled detent 54 into the (preferably) beveled slot 57 in the slotted plate 51 when the leg 16 is unfolded and locked in position. A first lock stop 61 on the slotted plate (FIG. 6) provides means for stopping further rotation of the leg past the locking position and serves to position the beveled detent 54 over the beveled slot 57. When the actuator portion 55 is released, the beveled detent 54 is urged into the beveled slot 57 by spring 58.

Figure 9:
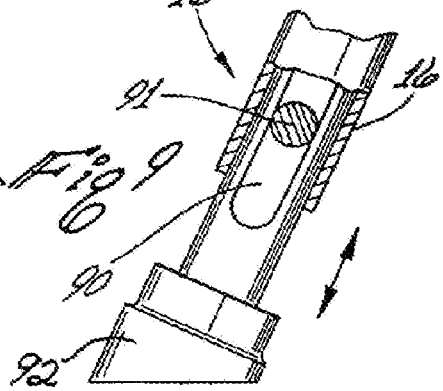
FIG. 9 is a cutaway view of a telescopically extendable leg wherein a scraper housed within the upper portion of the leg extrudes debris from an alignment slot in the lower portion of the leg when the leg is retracted to a nonextendable position.
Figure 10:
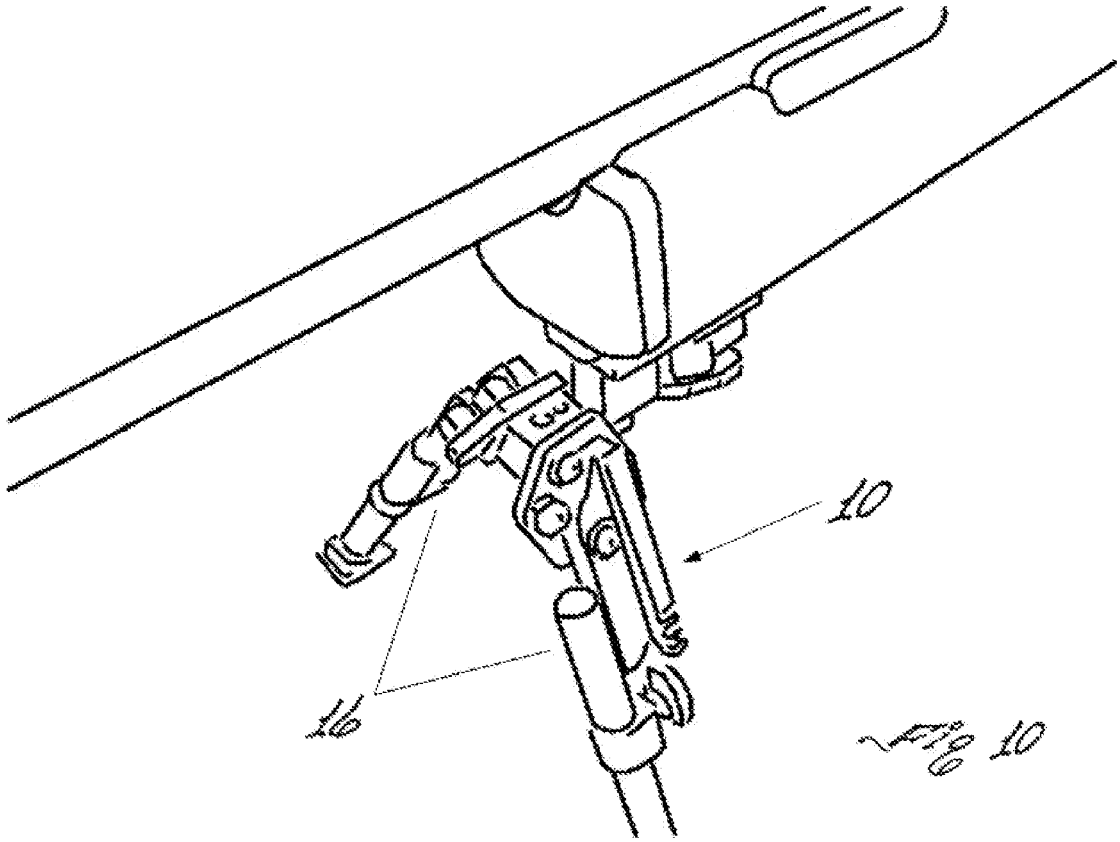
FIG. 10 shows an alternate view of the bipod illustrating the pivotally mounted legs.

The legs 16 of the bipod 10 are folded by depressing the actuator portion 55 of the lever 53 with the thumb thereby retracting the beveled detent 54 from within the beveled slot 57 and rotating the leg about the pivot rivot 56 until the lever mounting plate 63 abuts a second stop 64 thereby preventing further rotation. When the actuator portion is released, the beveled detent 54 is forced downwardly against an edge of the slotted plate 51 thereby locking the leg in a folded position wherein the legs are substantially parallel to the bipod mounting bracket 11 (not shown in FIG. 7). With reference to FIG. 9, the telescopically extendable legs 16, which are rigidly attached to the lever mounting plate 63, have a guide slot 90 in a lower portion of the leg to maintain the orientation of the foot 92 parallel to a grounded surface. Advantageously, a scraper 91 can be disposed within the upper portion of the leg 16 to remove debris from the slot 90 when the leg is retracted from an extended position.

In summary, the present invention discloses a bipod operable for attachment to a prior art bipod mounting plate (MIL-STD 1913 specification rail) that is, in accordance with standard practice in the prior art, rigidly attached to a firearm or an optical device such as, for example, a laser. Such prior art bipod mounting plates have at least one transverse slot on a lower surface thereof. The bipod comprises a bipod mounting bracket operable for rigidly and releasably engaging the transverse slot in the bipod mounting plate. The bipod mounting bracket is, in turn, either rigidly attached to, or integral with, a bipod mounting bracket support member. A slotted plate having a beveled slot therein is rigidly attached to, or is integral with, the mounting bracket support member. A pivotal attachment means is rotatably attached to the slotted plate. At least two telescopically extendable legs are rigidly attached to the pivotal attachment means. The pivotal attachment comprises a lever mounting bracket rotatably attached to the slotted plate and a lever pivotally mounted on the lever mounting bracket. The lever has a beveled detent on one end thereof and an actuator portion on the opposing end thereof, and a pivotal mount therebetween. A spring disposed on the lever mounting bracket so as to press against the actuator portion is operable for urging the beveled detent into the beveled slot thereby locking the legs into a predetermined angle with respect to the mounting bracket. Manual depression of the actuator portion of the lever retracts the beveled detent from within the beveled slot enabling the pivotal mounting means and the legs attached thereto to be folded. A second detent position locks the legs in a folded position for transport or standby. The beveled detent, together with the beveled slot, provides quiet deployment and deployment of the bipod. The use of a beveled detent on the lever also makes it easier to retract the detent from the slot.

While particular embodiments of the present invention have been illustrated and described, it would be obvious to those skilled in the art that various other changes and modifications can be made without departing from the spirit and scope of the invention. For example, the bipod mounting bracket, the mounting bracket support and the slotted plate can be machined or molded as a single component. While the bipod is preferably black, it can be made in any desired color, depending on the particular use. It is therefore intended to cover in the appended claims all such changes and modifications that are within the scope of this invention.

I claim:

1. A bipod operable for attachment to a bipod mounting plate having at least one transverse slot on a lower surface thereof, the bipod mounting plate being affixed to a firearm or optical device, said bipod comprising:

(a) a bipod mounting bracket operable for rigidly engaging said transverse slot in said bipod mounting plate;

(b) a bipod mounting bracket support rigidly attached to said bipod mounting bracket;

(c) a slotted plate rigidly attached to said bipod mounting bracket support, said slotted plate having a beveled slot therein;

(d) a pivotal attachment means rotatably attached to said mounting bracket support;

(e) a pair of telescopically extendable legs rigidly attached to said pivotal attachment means, said pivotal attachment means being operable for controlling the angle of orientation of the legs with respect to the bipod mounting bracket;

wherein said pivotal attachment means comprises a lever mounting bracket rotatably attached to said slotted plate, a lever pivotally mounted on said lever mounting bracket, said lever having a beveled detent on one end thereof and an actuator portion on the opposing end thereof, and a spring disposed on said lever mounting bracket operable for urging said beveled detent into said beveled slot thereby locking said legs into a predetermined angle with respect to said bipod mounting bracket.

* * * * *